US005934049A

United States Patent [19]

Cerf

[11] Patent Number: 5,934,049

[45] Date of Patent: Aug. 10, 1999

[54] AUTOMATED FILM WRAPPING APPARATUS

[76] Inventor: Alain Cerf, 3301 Gateway Centre Blvd., Pinellas Park, Fla. 33782

[21] Appl. No.: 09/014,005

[22] Filed: Jan. 27, 1998

[51] Int. Cl.[6] ..... B65B 53/02; B65B 9/02

[52] U.S. Cl. ..... 53/553; 53/557; 53/586; 53/582

[58] Field of Search ..... 53/557, 586, 582, 53/588, 553

[56] References Cited

U.S. PATENT DOCUMENTS

| | | | |
|---|---|---|---|
| 3,739,547 | 6/1973 | Brevko . | |
| 3,986,319 | 10/1976 | Puskarz et al. | 53/228 X |
| 4,041,674 | 8/1977 | Reid | 53/557 X |
| 4,319,443 | 3/1982 | Watts . | |
| 4,341,057 | 7/1982 | Limousin . | |
| 4,945,709 | 8/1990 | Cerf . | |
| 5,005,335 | 4/1991 | Yourgalite . | |
| 5,050,368 | 9/1991 | Noh . | |
| 5,069,016 | 12/1991 | Grossi | 53/586 X |
| 5,093,596 | 3/1992 | Hammer . | |
| 5,339,609 | 8/1994 | Cerf . | |
| 5,509,707 | 4/1996 | Schauer . | |
| 5,528,878 | 6/1996 | Edwards . | |
| 5,528,882 | 6/1996 | Yamamoto | 53/531 |
| 5,608,818 | 3/1997 | Chinc . | |
| 5,619,843 | 4/1997 | Ganz . | |
| 5,655,355 | 8/1997 | Ramler | 53/251 |

OTHER PUBLICATIONS

Rodico Inc. Two–Axis Robotic Tray Loader; Food & Drug Packaging Aug. '97 p. 13.

Dimension Industries Inc, Servo Controlled Pick–and Place System; Food & Drug Packaging Aug. 97 p. 36.

Pick and Place Case Packer, Food and Drug Packaging Jan. 98 p. 35.

Case Packers, Packaging World Dec. '97 p. 40.

ABB Flexible Automation, Food & Drug Packaging Robotic Top Load Packer. Jan. 98, p. 33.

*Primary Examiner*—Linda Johnson

*Attorney, Agent, or Firm*—Sam Silverberg

[57] ABSTRACT

A film wrapping apparatus comprising means for conveying an article resting on a platform along a path that include a wrapping station and a heat shrink tunnel. The wrapping station includes means for supplying heat shrinkable film from above and below the path so the film is disposed in the path of travel of the article and rests on the platform, means for sealing and severing the film behind the article after being wrapped by the film. A pick and place apparatus is used for mechanically transferring the article from a feed station and positioning the article atop the film while the film is resting on the platform. The transfer of the article is synchronized in response to the position of the platform.

21 Claims, 10 Drawing Sheets

AUTOMATED FILM WRAPPING APPARATUS

BACKGROUND OF THE INVENTION

1. Field of the Invention

This invention relates to automating a wrapping machine for packaging or bundling articles, typically in a thermoplastic shrinkable film.

2. Description of the Related Art

Machines for moving an article or groups of articles through the plane of a continuous film, wrapping the article or articles with the film, sealing and severing the film, and than shrinking the film around the article or articles, are exemplified by U.S. Pat. Nos. 5,046,600; 4,870,802; 4,365,456; 4,319,443; 3,739,547; 4,341,057 and 3,191,356. These patents are incorporated by reference. Basically, such machines provide a generally horizontal conveyor for moving the articles along a path. A film is vertically extended across the path of the articles from supply rolls above and below. As leading edge of the articles is moved through the plane of the film each roll rotates thereby supplying additional film that wraps the articles. As each article displaces the film a portion of the film drawn from below and another portion of the film drawn from above, cover the front and top of the article. A moving bar pulls the film from above behind the article thereby wrapping the article. After wrapping the article, the film is sealed and severed behind the article. The film is sealed across the width of the film along two spaced lines and is severed between the lines. This results in a wrapped article, which is separated from the remaining film. The remaining film is united to the upper and lower rolls by the seal so that the next article or group of articles can intercept the film. Then the wrapped article is moved through a heated tunnel to shrink the film.

Because a conveyer is used to advance the article into the plane of the wrapping film, these machines have lent themselves to automation. Pick and place machines have been used to automatically transfer the article from a feed station and a place the article directly on the conveyor.

Another method of transferring article on the conveyer has been to manually place the article directly on the wrapping film. The article is placed on the wrapping film while a portion of the film is in a substantially horizontal position to the conveyor. U.S. Pat. No. 5,619,843 shows automatically placing the article directly on a film resting on platens driven by the conveyer. The article is moved on the film by pushing the article onto the film.

These machines shown in the references or in existence are both expensive and complex. Also, where a variety of product sizes and shapes are to be packaged, a particular machine configuration may be inefficient for some of the sizes or shapes.

This invention has solved the problem in the art by producing a pick and place apparatus that is simple to operate and inexpensive to construct. The apparatus can transfer an article in at least two axis. The apparatus has the ability to manipulate the article by rotating, orienting and collating articles of various shapes and groupings. This results in a more efficient and versatile apparatus. This apparatus allows placing an article directly on the film prior to film wrapping. None of the machines in the prior art have produced a simple and inexpensive machine that automatically places the article directly on the film.

SUMMARY OF THE INVENTION

The foregoing has outlined rather broadly the more pertinent and important features of the present invention in order that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other wrapping machines for carrying out the same purposes of the present invention. It should also be realized by those skilled in the art that such equivalent structures do not depart from the spirit and scope of the invention as set forth in the appended claims.

The invention is directed to a film wrapping apparatus comprising means for conveying an article resting on a platform along a path that include a wrapping station and a heat shrink tunnel. Through out the entire specification and claims the word article means a single article or a group of articles. The article can have a variety of shapes and sizes.

The wrapping station includes means for supplying heat shrinkable film to a platform and means for sealing and severing the film. The film is supplied from above and below the path so that said film is disposed in the path of travel of the article. The film rests on the platform prior to placing an article on the platform. The article is placed on the platform by means for mechanically transferring the article from a transfer station and position the article atop the film while the film is resting on the platform. After being wrapped by the film, the film is sealed and severed behind the article. The wrapped article is moved to a heat tunnel for heat shrinking the film. The film wrapping apparatus is automated by means for synchronizing the transfer of the article in response to the positioning of the platform. The conveyor that moves the platform can be operated intermittently or continuously.

The means for mechanically transferring the article is done by a pick and place apparatus. This apparatus has a conveyor that drives an arm having a gripper. The gripper picks up the article from a feed station and moves the article toward the platform and places the article on the film. The film rests on the platform when the article is placed onto the film. The conveyor has a minimum movement that can be defined by two axes. A single power source can drive the conveyor when the wrapping machine is operated intermittently. The power source can be a single servo or a stepper motor or single air cylinder containing a compressed gas. The gas can be air. Plural power sources are needed to drive the conveyor when the wrapping machine is set for continuous operation. For continuous motion of the platform conveyor, plural motors are used to drive separate drive belt for moving the arm along the x-axis and y-axis.

The gripper is capable of manipulating the article while the article is being transferred. In mid air the gripper can rotate the article thereby repositioning the axis of the article. An independent means are used for driving the gripper. The gripper can be adjusted or changed for different shapes or dimensions.

The pick and place apparatus can transfer the article from a feed station to the wrapping station regardless of the orientation between the two stations. This allows the means for conveying the article to be positioned at any angle to a feed station. Parallel or perpendicular positioning is achievable. The transfer can be done in line, at ninety degrees and if necessary with a reorientation of the article. This allows transfer of the article from a single lane feed conveyor to a dual lane on the wrapping machine where the article can be placed side by side, or transferring the article from a dual lane feed conveyor to a single lane on the film wrapping apparatus. For ease of movement the pick and place apparatus can be mounted on wheels. A pick and place apparatus can be used to remove the wrapped article from the heat shrink machine.

BRIEF DESCRIPTION OF THE DRAWINGS

For a fuller understanding of the nature and objects of the present invention reference should be made by the following detailed description taken in with the accompanying drawings in which.

DETAILED DESCRIPTION OF THE INVENTION

Figure 1:
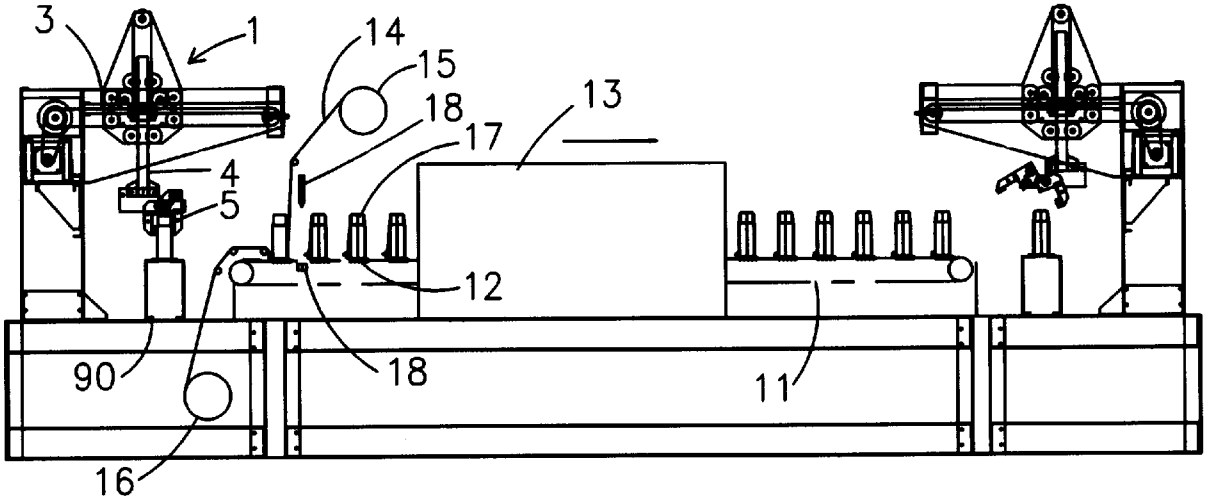
FIG. 1 shows a film wrapping apparatus with a pick and place apparatus loading and unloading the article to be wrapped.
Figure 2:
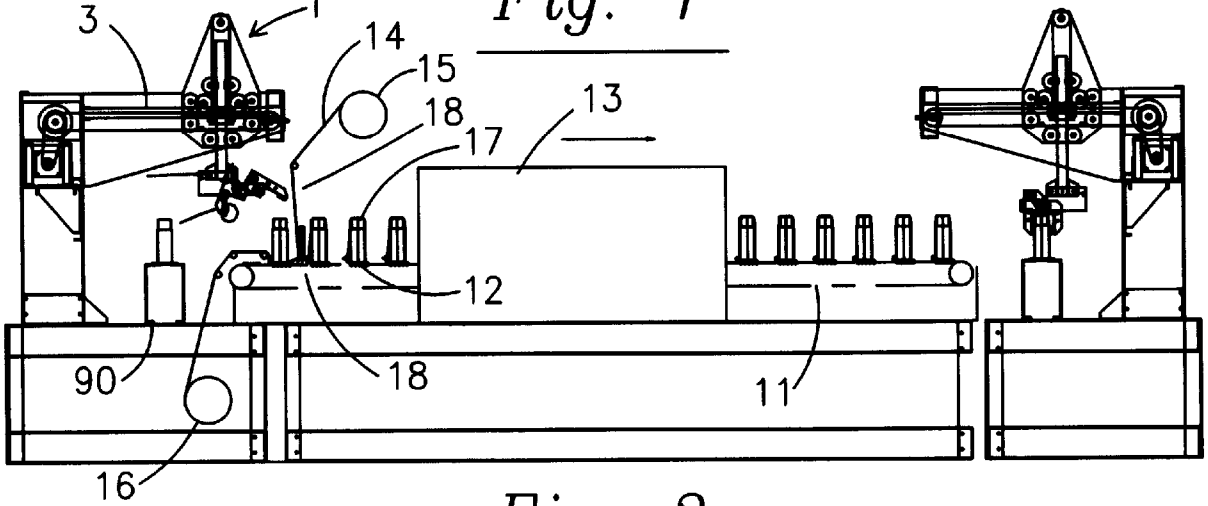
FIG. 2 shows a different position of the article as it moves through the film wrapping apparatus.

Referring to FIGS. 1 and 2, the reference numeral 10 refers to a heat shrink wrapping machine. The machine has a conveyor 11 driving a platform 12, known in the art as a bucket. The platform can be any size or shape. The platform 12 carries article 17 through a heat shrink tunnel 13. The article 17 is positioned atop of film 14. The film 14 rests on platform 12 before article 17 is placed. The film 14 extends from an upper film roll 15 to lower film roll 16. The film is generally vertically disposed in the path of travel of article 17 so that the leading edge of each article causes upper roll 15 and lower roll 16 to rotate there by supplying additional film as each article displaces the vertically disposed film barrier. Lower and upper seal bar 18 cut and seal the film. When the wrapping machine is operated continuously, the movement of the lower and upper seal bar must coordinated with the movement of the platform. A carriage controls the movement of the sealing bars. The carriage with the sealing bar moves at the same speed as the conveyor. After sealing, when the sealing bar clears the article the carriage with the sealing bar is moved back to its home position.

The pick and place apparatus 1 has a conveyor 3 that drives an arm 4. The arm 4, using a gripper 5, transfers the article 17 from a transfer station 90 and positions the article 17 atop film 14. The article is usually transferred by moving the arm along a path that can be defined by reference to a x-axis (horizontal direction) and y-axis, (vertical direction). The conveyor 3 moves the arm 4 in at least a vertical and horizontal direction.

Figure 3:
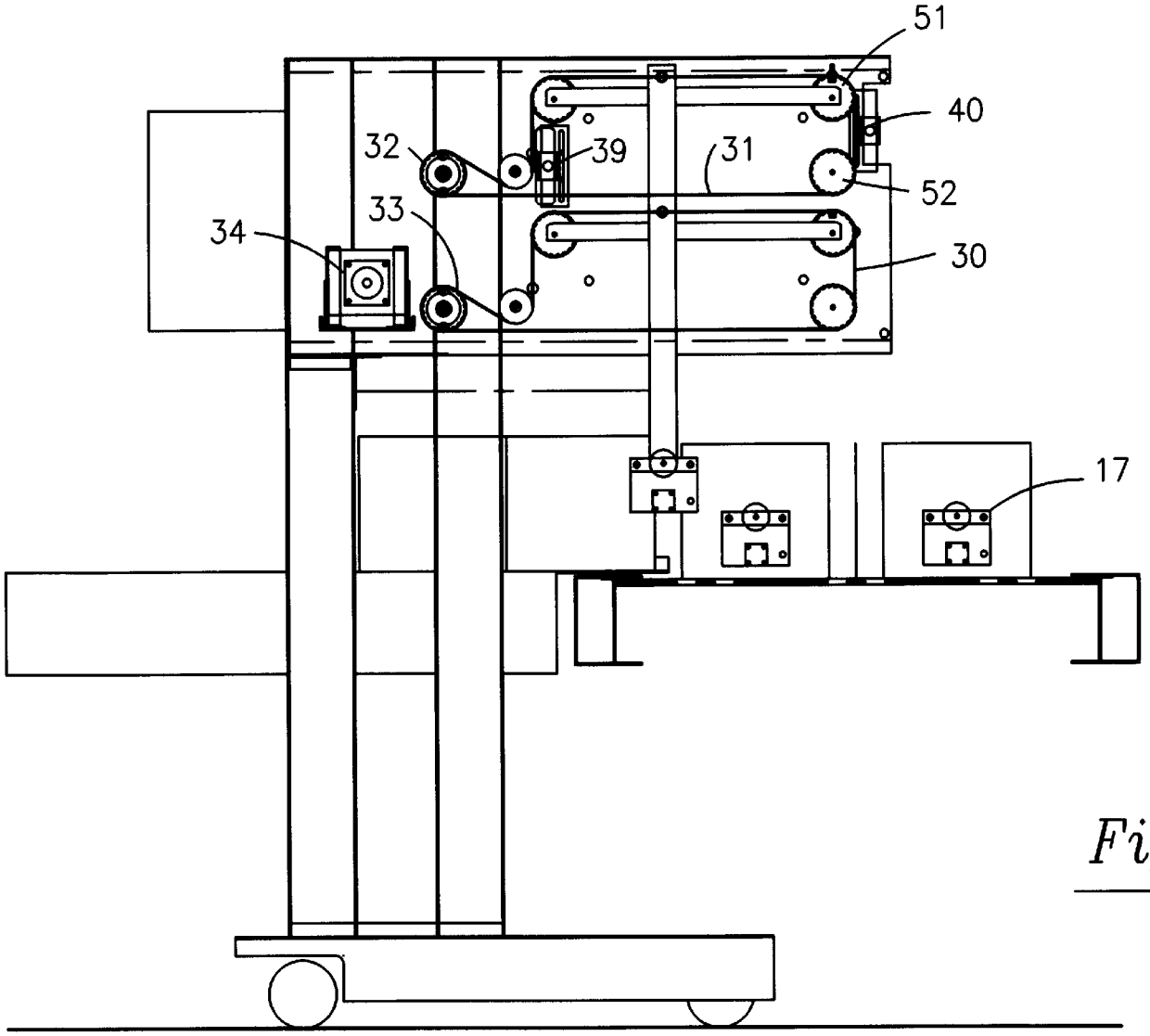
FIG. 3 shows a side view of a pick and place apparatus moving an article.
Figure 4:
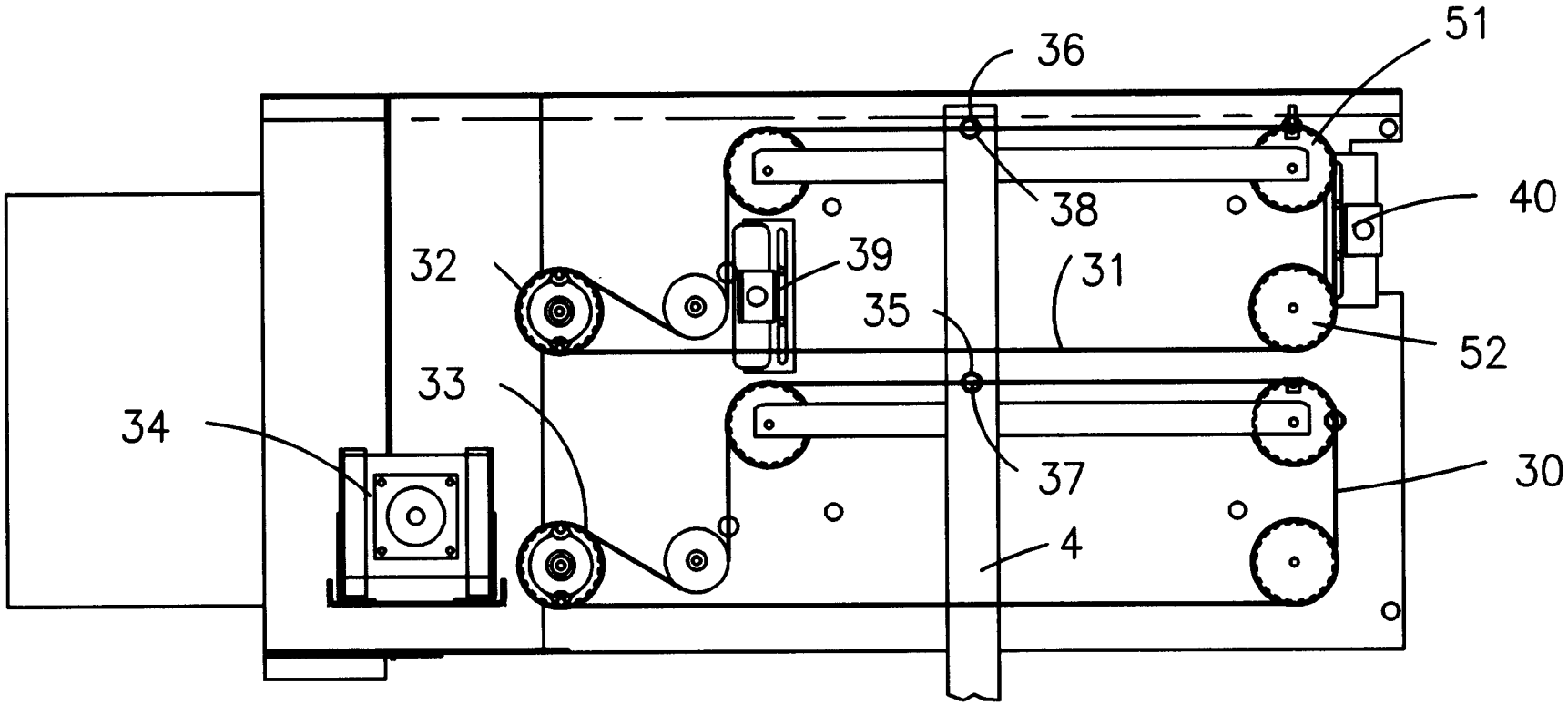
FIG. 4 shows the movement of the drive belts in the x and y direction.
Figure 5:
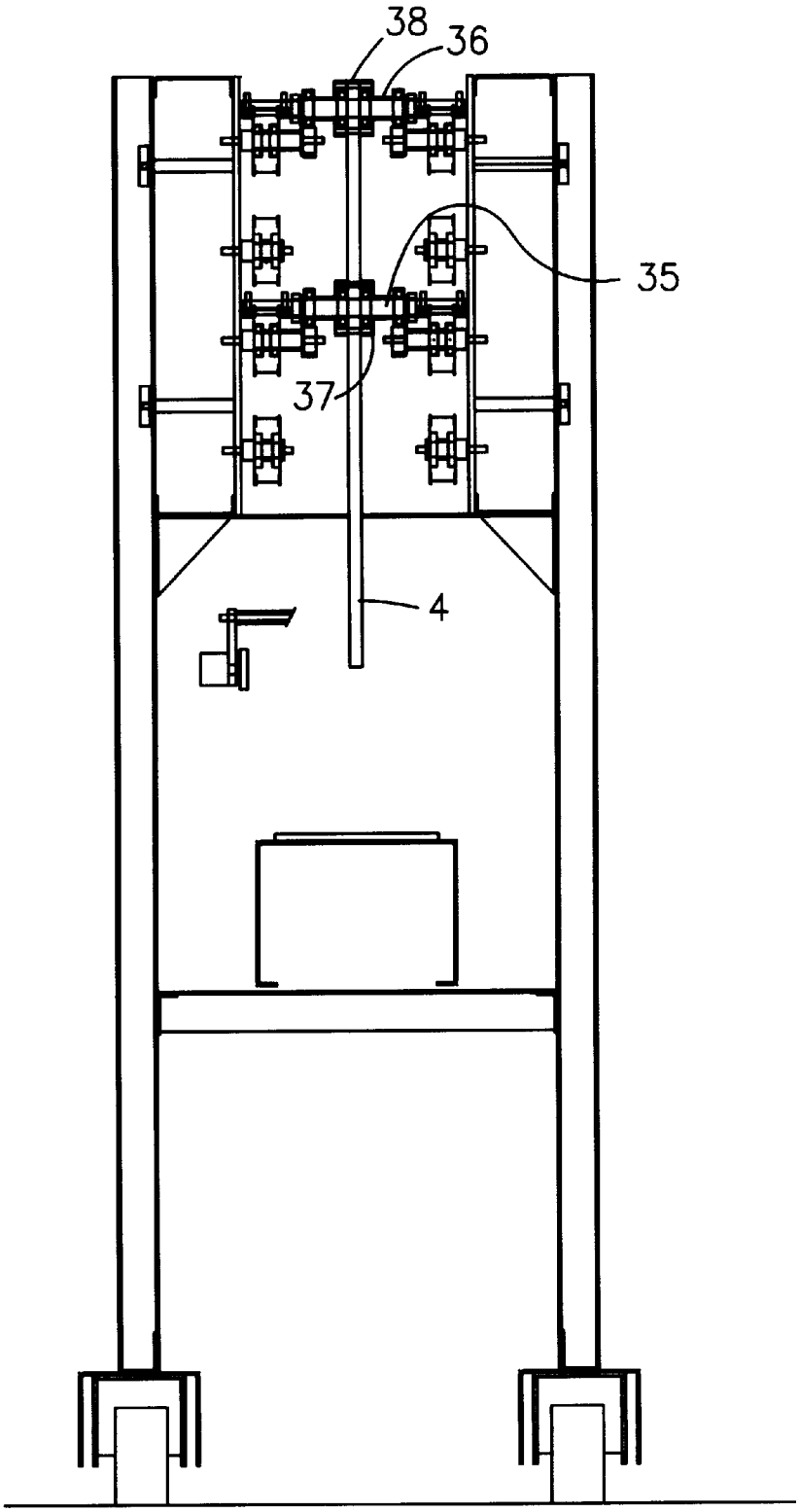
FIG. 5 shows the attachment of the arm to the cross bar members.

In a preferred embodiment, FIGS. 3, 4 and 5, show a pick and place apparatus to be used for a wrapping apparatus wherein the conveyor that drives platform 12 is operated intermittently. Intermittent means that the conveyor stops to allow the sealing and cutting of the film. The conveyor 3 has pulleys 32 and 33 that drives a lower drive belt 30 and an upper drive belt 31. A single motor 34 drives pulleys 32 and 33. A single motor 34 is linked to the pulleys through a timing belt that synchronized the movement of the drive belts. FIG. 5 shows upper drive belt 31 driving cross member 36 by and lower drive belt 30 driving lower cross member 35. Arm 4 is connected to the upper and lower cross member at 37 and 38. Proximity switches 39 and 40 are used as indicators for the position of arm 4. When a motor is used to drive the pulleys, a proximity switch is used to indicate the home position of the arm at the start of the wrapping machine. A proximity switch is used at the end of the stroke for security.

For intermittent operation of the wrapping machine, a single servomotor or stepper motor or an air cylinder containing compressed air can be used to drive pulleys 32 and 33 operated. When an air cylinder is used proximity switches have to be used to indicate the position of the arm.

As shown in FIG. 3, the amount vertical movement of arm 4 to pick up article 17 from a feed station and to place article 17 on top film layer 14 is controlled by the vertical travel of the drive belts. The distance the drive belt travels horizontally controls the movement of arm 4 in the horizontal direction.

The gripper 5 is able to manipulate the article independently of the conveyor 3. Gripper 5 has an independent drive. An air cylinder containing compressed gas drives the gripper. The gripper can rotate and reposition article 17 in mid air. The gripper can have expandable fingers that can be inserted into an opening of an article to secure the article. The construction of grippers is conventional in the art. U.S. Pat. Nos. 4,595,333; 4,819,978; 4,456,293; 4,680,523; 4,920,572; 4,727471; 4,544,193; and 5,608,818 show grippers. These references are incorporated by reference.

After article 17 is driven through the heat shrink tunnel 19 by a conveyor 21, a pick and place apparatus 2 can unload article 17 from the platform to a discharge station. The discharge station can be a discharge conveyor 22. A robotic arm can replace the pick and place apparatus 1 and 3.

Figure 6:
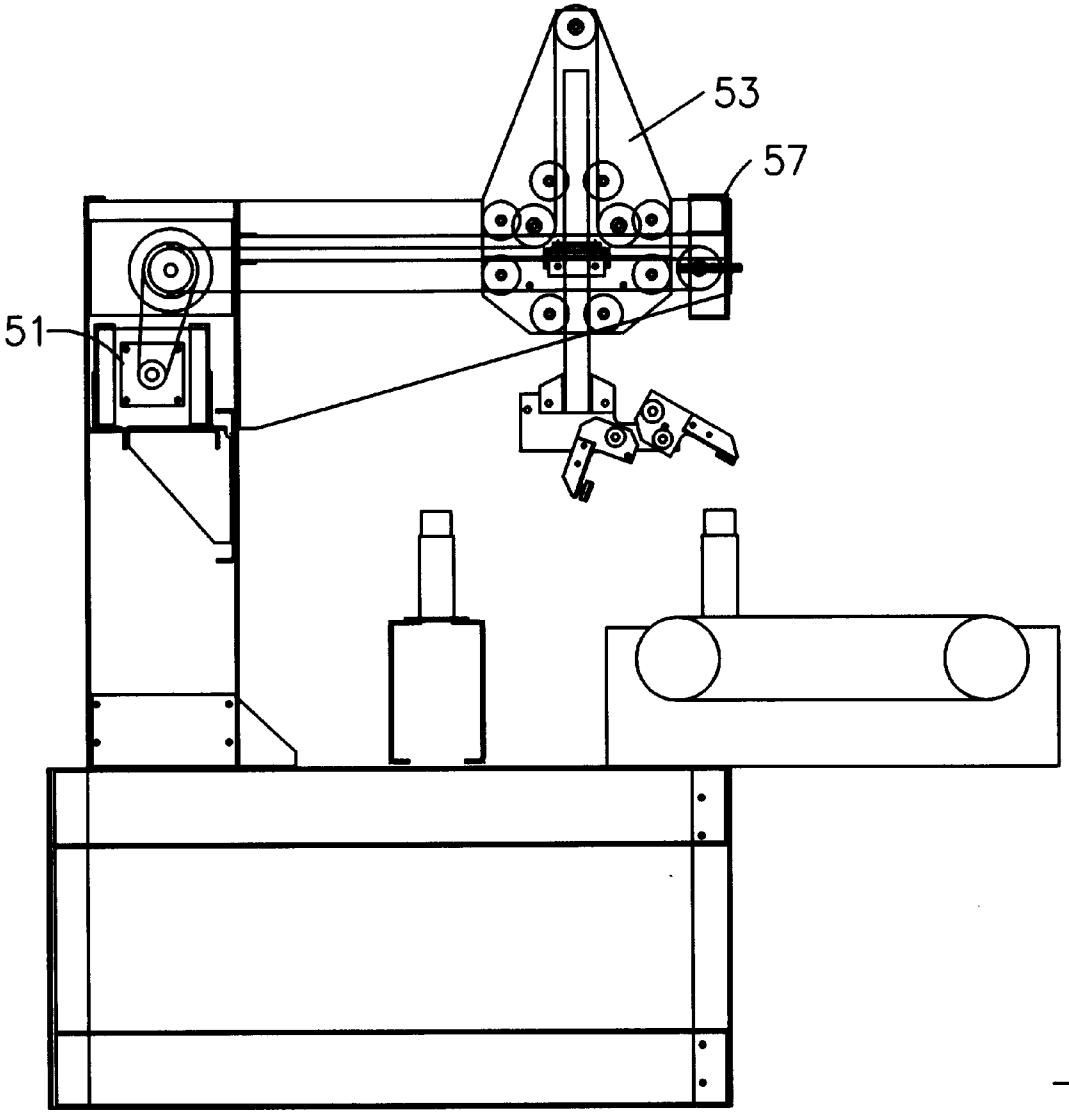
FIG. 6 shows a side view of the pick and place apparatus used in a continuous film wrapping apparatus.
Figure 7:
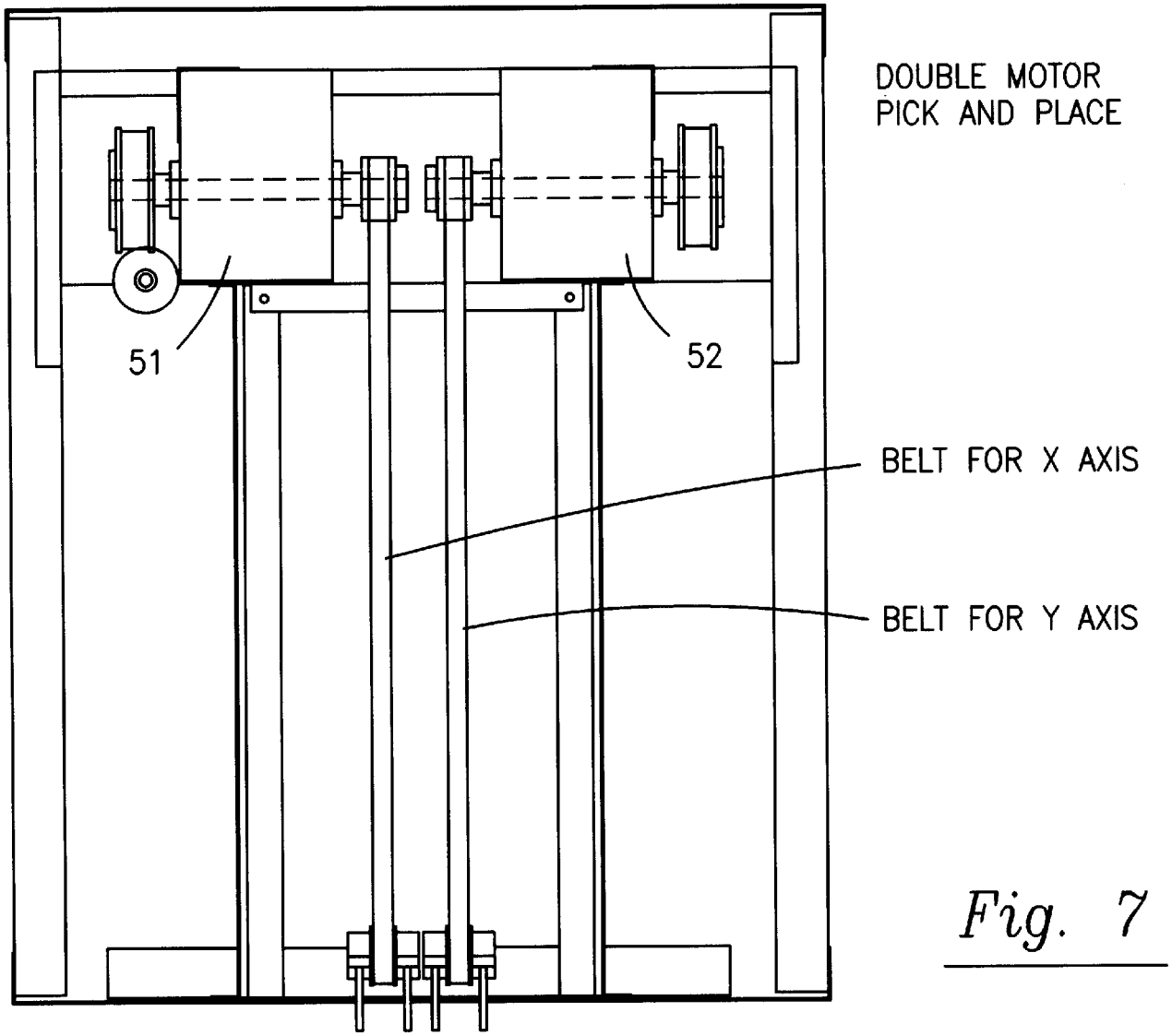
FIG. 7 shows two drive belts moving the arm the in the x and y-axis for the apparatus of FIG. 6
Figure 8A:
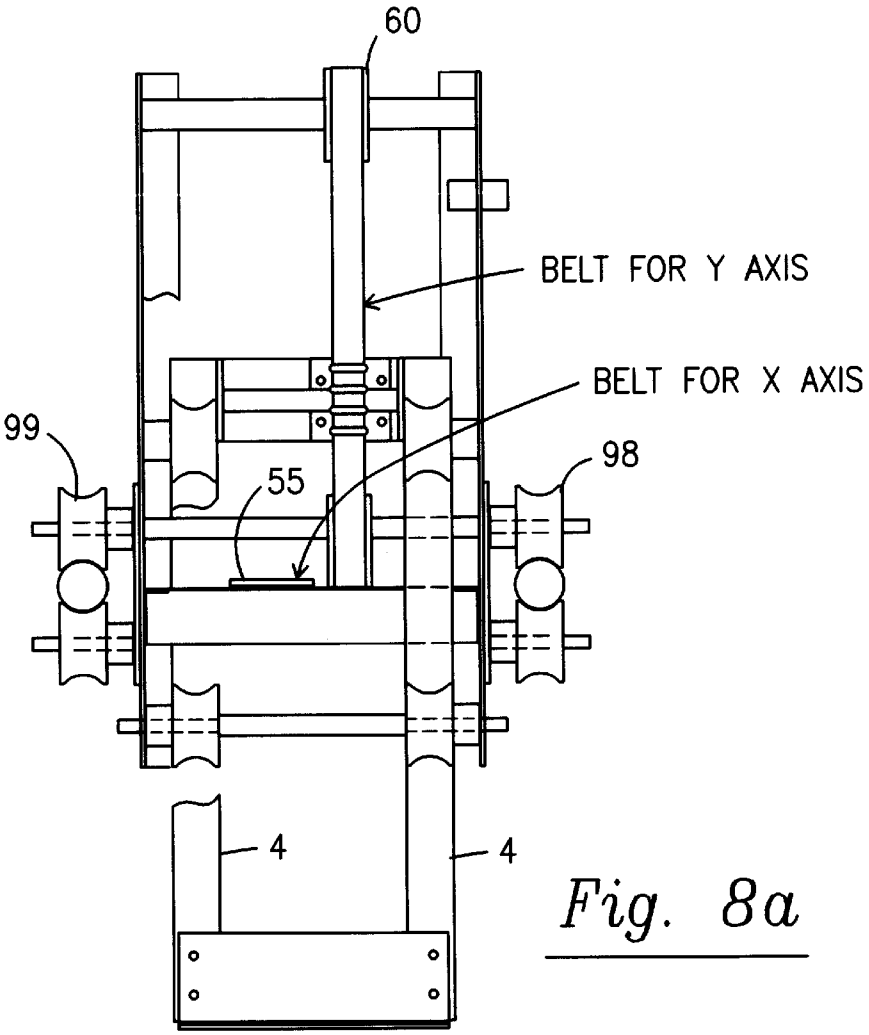
FIGS. 8 and 8A shows the carriage and drive belts for the apparatus of FIG. 6
Figure 8:
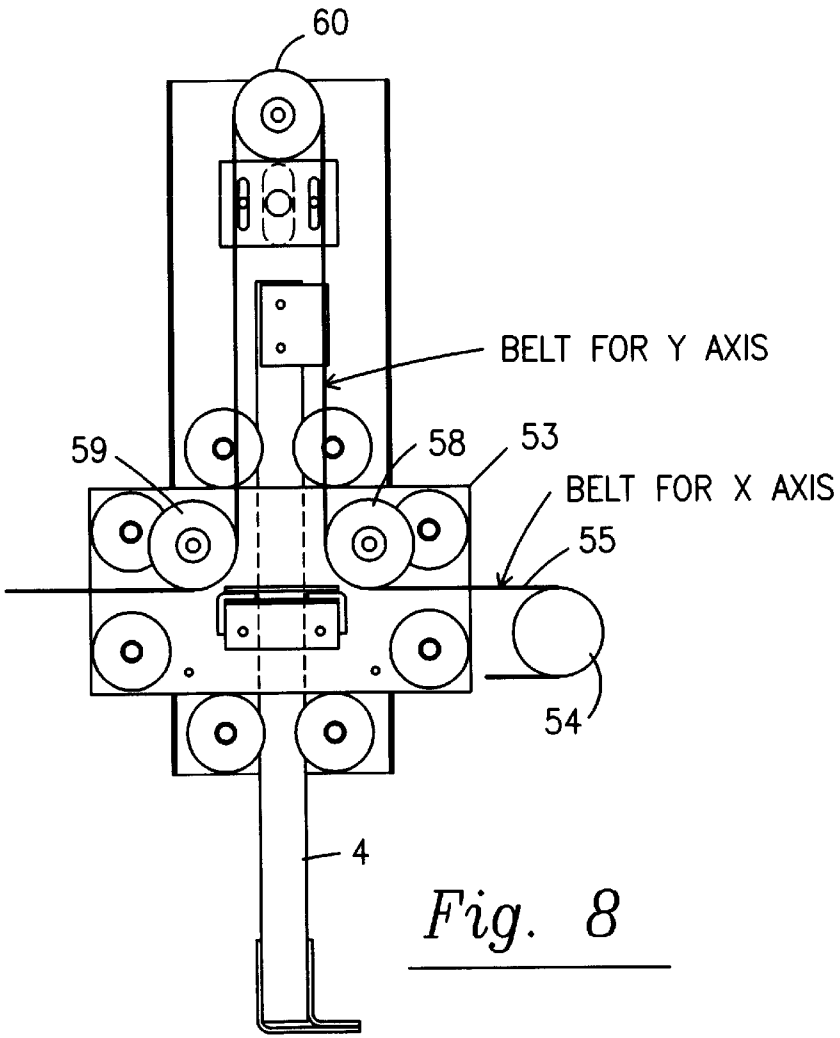

The pick and place apparatus illustrated in FIGS. 6, 7, and 8, shows an embodiment used for continuous operation. FIGS. 7 and 8 show two drive motors 51 and 52. One motor drives belt 55 so that carriage 53 moves along the x-axis. Since arm 4 is attached to carriage 53, arm 4 moves along the x-axis. Belt 55 forms a loop by going around an idler pulley located behind pulley 54. The idler pulley is attached to frame 57. The other motor drives belt 56 so that arm 4 moves along the y-axis. This is accomplished by the belt 56 traveling around idler pulley 54 and pulleys 58,59 and 60. Idler pulley 54 is fixed to the frame 57. Pulleys 58,59, and 60 are fixed to carriage 53. The operation of this conveyor can be explained by the movement of the arm when only one motor is running. When the motor driving belt 56 runs, arm 4 moves up or down. No horizontal motion is created. When the only motor running is driving belt 55 thereby moving the carriage 53 with attached arm 4 along the x-axis. The movement of the carriage 53 causes pulleys 58,59, and 60 to move belt 56, thereby creating vertical movement along the y-axis. Therefore when the belts are driven at the same speed there is no movement in the vertical direction, because the movement of carriage 57 causes pulleys 58,59, and 60 to counteract the movement along the y-axis. Vertical motion is created when there is difference in speeds between belts 55 and 56. By manipulating the speeds of the belts a downward sloping direction can be created. For continuous operation the placement of the article 17 on the moving platform 12, the arm must be lowered while traveling at least at the same speed as the platform. Since movement in the x-axis creates movement in the y-axis, a sloping direction can be created that allows positioning of article 17 on the moving platform. After the placement of article 17, arm 4 must be moved back to its home position without interfering with the wrapping operation. This can be achieved by moving the arm 4 in the same direction as the platform and at least at the speed of the platform. This can be accomplished by programming the conveyor to move the arm in upward slope, wherein the vertical component of travel is sufficient to clear any obstructions. FIG. 8A shows pulleys 98 and 99 to move the carriage along the X-axis.

Figure 9:
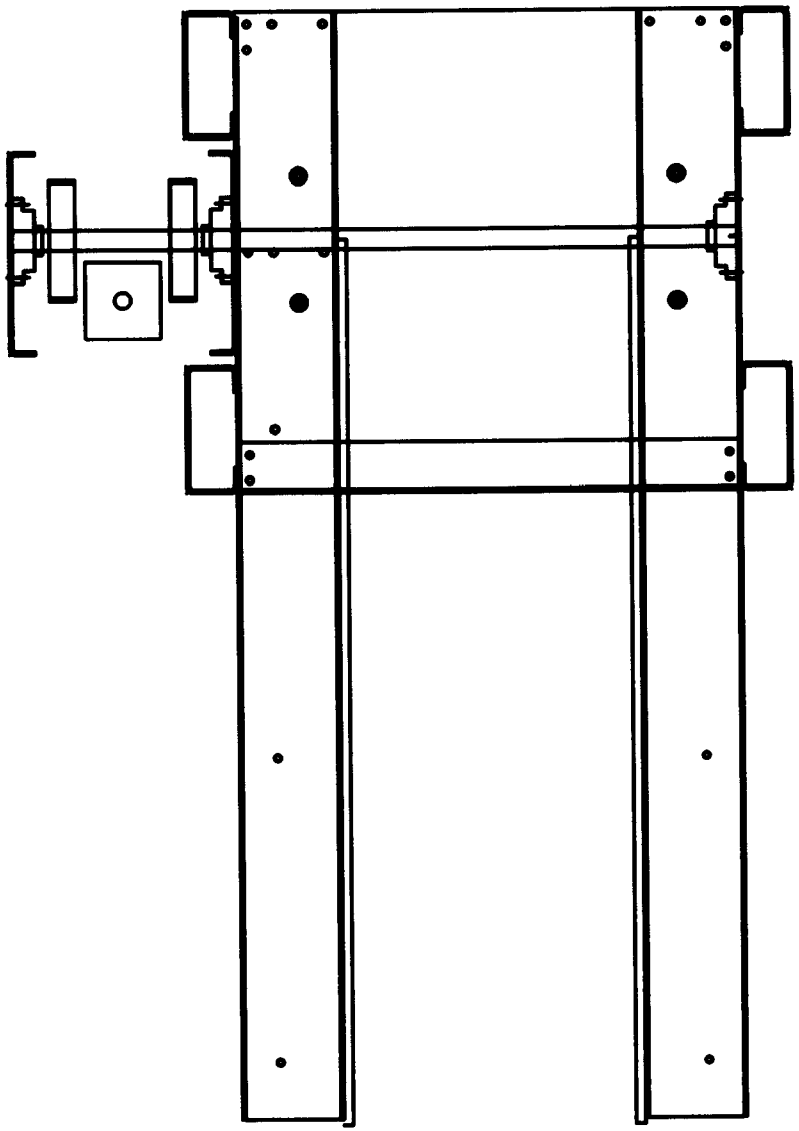
FIGS. 9–11 show the use of a gas cylinder to drive the conveyor.
Figure 10:
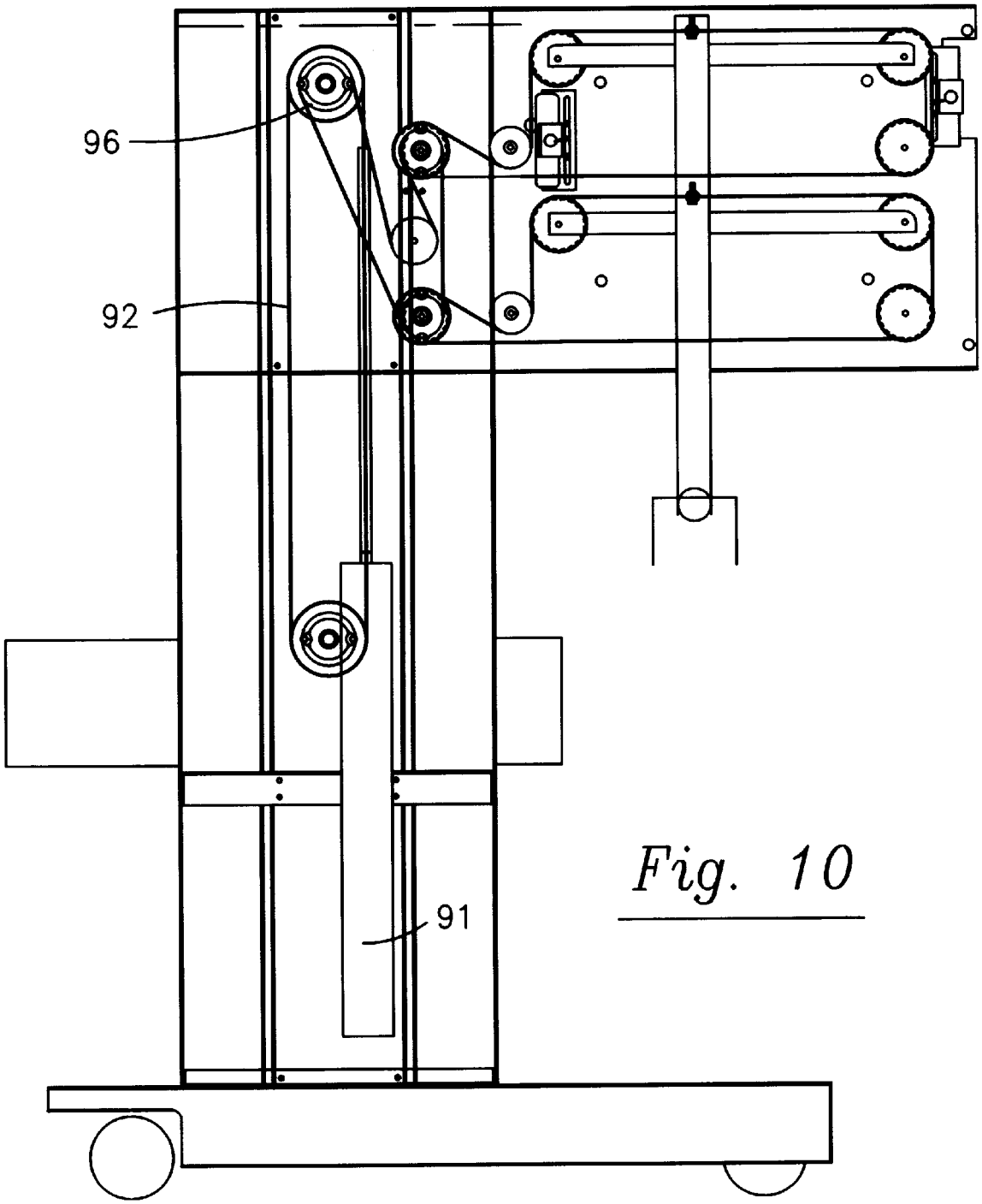
Figure 11:
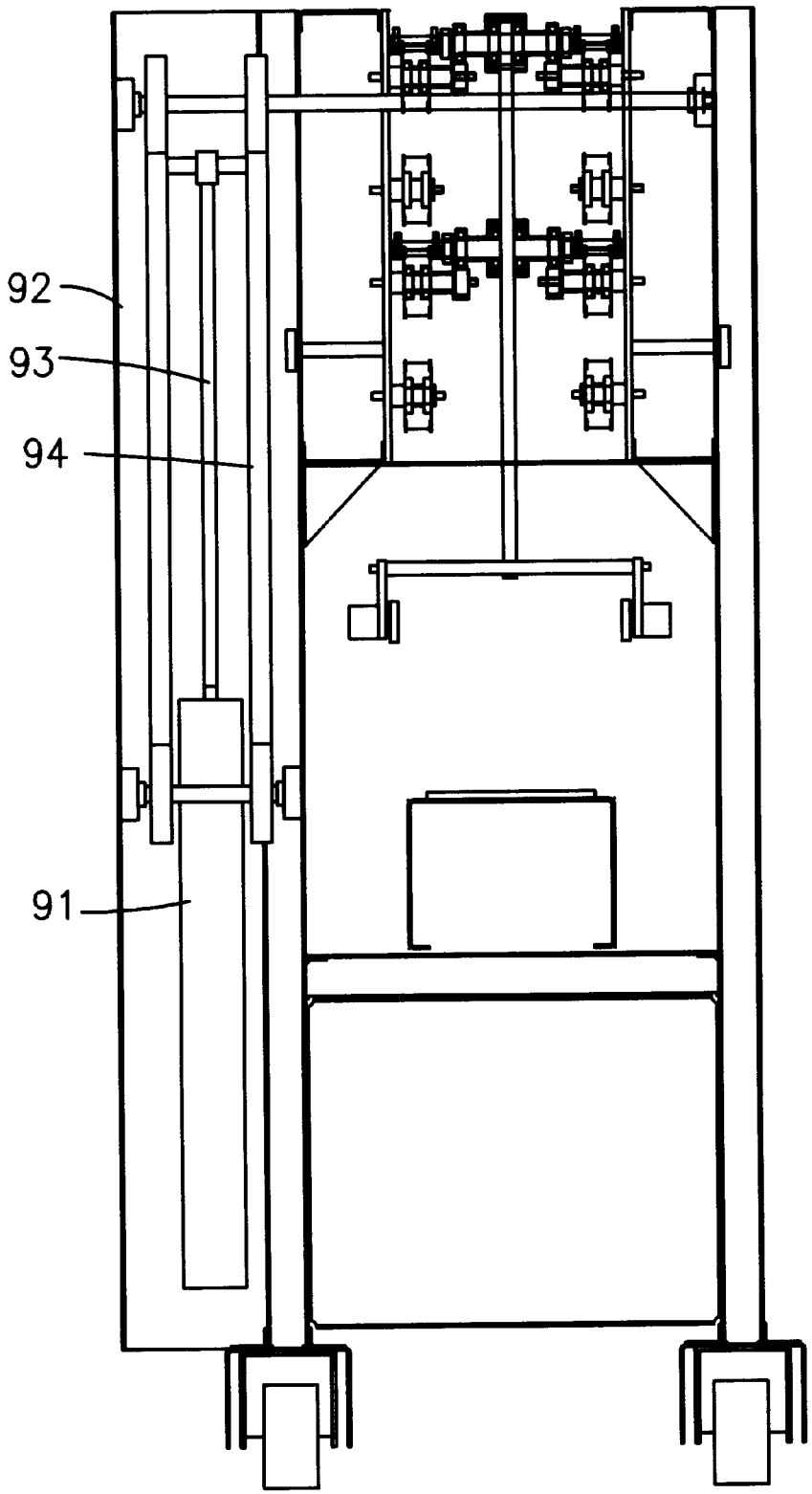

The use of an air cylinder to power a film wrapping machine for intermittent operation is illustrated in FIGS. 9–11. The conveyor path is the same as shown in FIGS. 3 and 4. The compressed gas cylinder 91 drives belts 92 and 94. Element 93, a piston rod, of the gas cylinder is attached belts 92 and 94. The up and down movement of element 93 causes belt 92 and 94 to move. When means is used in the specification and claims, any means in the specifications capable of performing the function is included the term.

A central processing unit (CPU) controls the movement of the pick and place machine and the operation of the wrapping machine. The CPU sends information to an inverter controlling the speed of the platform conveyor and to a stepper motor (or servo) controlling the arm movement and speed of the pick and place conveyor. The CPU will start the pick and place conveyor and synchronize the movement of the gripper with the movement of the platforms. These movements include: 1. Gripping the article on a infeed conveyor; 2. Vertically lifting the article clear of all obstructions; 3. Moving the article at a higher speed than the platform conveyor to a position above the platform; 4. Changing the speed of the conveyor to approximately the same speed of the platform conveyor and vertically place the article on the platform; 5. Release the article from the gripper and move the gripper up to clear any obstructions; 6. Move the gripper back to its home position.

With respect to the above description then, it is to be realized that the optimum dimensional relationships for the parts of the invention, to include variations in size, materials, shape, form, function and manner of operation, assembly and use, are deemed readily apparent and obvious to one skilled in the art. All equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

Now that the invention has been described,

What is claimed is:

1. A film wrapping apparatus comprising means for conveying an article resting on a platform along a path that include a wrapping station and a heat shrink tunnel, the wrapping station includes means for supplying heat shrinkable film from above and below the path so the film is disposed in the path of travel of the article and rests on the platform, means for sealing and severing the film behind the article after being wrapped by the film, means for mechanically transferring the article from a feed station and positioning the article atop the film while the film is resting on the platform wherein said means includes means to pick up the article and lift the article above the platform and then lower the article onto the platform, means for syndchronizing the transfer of the article in response to the position of the platform.

2. The apparatus of claim 1 wherein the means for supplying heat shrinkable film has the film extending from an upper film roll to a lower film roll so that the film is generally vertically across the path of the article whereby the leading edge of the article causes each roll to rotate thereby supplying additional film as each article displaces the vertically disposed film barrier.

3. The apparatus of claim 1 wherein the means for conveying the article on the platform includes a conveyor that can be operated continuously or intermittently.

4. The apparatus of claim 1 wherein the means for mechanically transferring the article includes a conveyor that drives an arm having an attached gripper to pick up the article from the feed station, places the article on the top of the film and releases the article.

5. The apparatus of claim 4 wherein the article is transferred by moving the arm along a path that can be defined by reference to an x-axis and y-axis.

6. The apparatus of claim 5 wherein the article is transferred by picking up the article from a vertical direction and moving the arm in a horizontal direction toward the film and lowering the article vertically to place the article on top of the film.

7. The apparatus of claim 5 wherein the means conveying the article oh the platform operates the conveyor for intermittent movement and wherein the conveyor that moves the arm is driven by a single power source.

8. The apparatus of claim 7 wherein the arm is attached to two cross bar members that are driven by separate drive belts.

9. The apparatus of claim 5 wherein the conveyor is driven by one or more motors.

10. The apparatus of claim 7 wherein the single power source is a single servomotor or single stepping motor or an air cylinder containing compressed gas that is used to drive the conveyor.

11. The apparatus of claim 5 wherein the gripper is able to manipulate the article independently of the conveyor.

12. The apparatus of claim 11 wherein the gripper can rotate and reposition the article in mid air.

13. The apparatus of claim 11 wherein an air cylinder containing compressed gas drives the gripper.

14. The apparatus of claim 11 wherein the gripper has expandable fingers that can be inserted into an opening of an article to secure the article.

15. The apparatus of claim 1 including a means to mechanically transfer the article from the platform to a discharge station after the article comes out of the heat shrink tunnel wherein said means is synchronized to pick up the article in response to the position of the platform.

16. The apparatus of claim 1 wherein the means to mechanically transfer the article includes a robotic arm.

17. The apparatus of claim 4 wherein the means to mechanically transfer the article is mounted on wheels.

18. The apparatus of claim 5 wherein the conveyor that moves the arm includes one motor that moves the arm along a y-axis and a second motor that moves the arm along a x-axis.

19. The apparatus of claim 18 wherein the arm is attached to a carriage in an arrangement so that the second motor causes a movement in the vertical direction when the arm is moved along the x-axis.

20. The apparatus of claim 19 wherein the conveyor is programmed to move the arm in a slanted direction defined by a vertical and horizontal component by manipulating the speed of the motors.

21. The apparatus of claim 6 wherein the means conveying the article in the platform operates the conveyor for intermittent movement and wherein the conveyor that moves the arm is driven by a single power source.

* * * * *